US009217956B1

(12) United States Patent
Wegman

(10) Patent No.: US 9,217,956 B1
(45) Date of Patent: Dec. 22, 2015

(54) DISPENSE-END SEAL FOR TONER CONTAINERS

(71) Applicant: XEROX CORPORATION, Norwalk, CT (US)

(72) Inventor: Paul M. Wegman, Pittsford, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/486,036

(22) Filed: Sep. 15, 2014

(51) Int. Cl.
*G03G 15/08* (2006.01)

(52) U.S. Cl.
CPC ..... *G03G 15/0898* (2013.01)

(58) Field of Classification Search
USPC ..... 399/281, 102, 106
See application file for complete search history.

(56) References Cited

U.S. PATENT DOCUMENTS

| | | | | |
|---|---|---|---|---|
| 8,532,522 | B2 * | 9/2013 | Kawamura et al. | 399/102 |
| 2005/0008398 | A1 * | 1/2005 | Hattori | 399/258 |
| 2009/0129811 | A1 * | 5/2009 | Katsuyama et al. | 399/106 |

* cited by examiner

*Primary Examiner* — Quana M Grainger
(74) *Attorney, Agent, or Firm* — MH2 Technology Law Group LLP

(57) ABSTRACT

A toner container assembly including a seal assembly. The seal assembly can include an outer retainer ring having a non-adhesive carrier, a first adhesive layer on a surface of the non-adhesive carrier, and a first opening through the outer retainer ring. The seal assembly can further include a foam ring having a second opening therethrough, wherein the foam ring is attached to the outer retainer ring with the first adhesive, and a double-sided adhesive attached to the foam ring. The seal assembly may further include a solid foam disc having a first slit therethrough and a second slit therethrough, wherein the first slit is perpendicular to the second slit and the solid foam disc is attached to the foam ring by the double-sided adhesive layer.

15 Claims, 4 Drawing Sheets

DISPENSE-END SEAL FOR TONER CONTAINERS

TECHNICAL FIELD

The present teachings relate to the field of printing devices and, more particularly, to a toner container for use with a printing device.

BACKGROUND

Printing devices such as laser printers use a powdered toner to form text or an image. The toner within a portable toner container (e.g., a toner bottle or cartridge) is placed within the printer, then the toner is dispensed from the container. For example, a dispense auger from the printer can be inserted into an opening in the container, then the bottle and/or dispense auger may rotate to feed the toner into the auger. The toner is then transported to the print engine.

During the insertion or removal of the auger from the opening in the container, or during transport of the printer, the solid powdered toner can leak from the container and into the printer. Periodic maintenance is typically performed to remove toner contamination from the inside of the printer, as this toner can decrease print quality and the lifetime of the printer.

In an attempt to reduce toner leakage, a permanent seal may be placed at the opening of the container. The foam seal includes two slits that are perpendicular to each other. During use, the dispense auger extends through the slits and into the container. However, the length of slits are larger than the diameter of the auger so that the foam seal is not damaged during insertion of the auger, and toner may leak from the ends of the slits during use of the printer, during insertion and removal of the auger, and/or during transport of the printer.

A toner container that is less prone to toner leakage, and a printer including the toner container, would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

An embodiment of the present teachings include a toner container assembly for a printer, the toner container assembly including a seal assembly, wherein the seal assembly includes a outer retainer ring comprising a non-adhesive carrier, a first adhesive layer on a surface of the non-adhesive carrier, and a first opening through the outer retainer ring, a foam ring comprising a second opening therethrough, wherein the foam ring is attached to the outer retainer ring with the first adhesive, a double-sided adhesive layer attached to the foam ring, and a solid foam disc comprising a first slit therethrough and a second slit therethrough, wherein the first slit is perpendicular to the second slit and the solid foam disc is attached to the foam ring by the double-sided adhesive layer.

Another embodiment of the present teachings can include a printer having a toner container assembly including a seal assembly, wherein the seal assembly includes a outer retainer ring comprising a non-adhesive carrier, a first adhesive layer on a surface of the non-adhesive carrier, and a first opening through the outer retainer ring, a foam ring comprising a second opening therethrough, wherein the foam ring is attached to the outer retainer ring with the first adhesive, a double-sided adhesive layer attached to the foam ring, and a solid foam disc comprising a first slit therethrough and a second slit therethrough, wherein the first slit is perpendicular to the second slit and the solid foam disc is attached to the foam ring by the double-sided adhesive layer. The printer can further include. The printer can further include a printer housing that encases the toner container assembly.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc. Unless otherwise specified, the word "polymer" encompasses any one of a broad range of carbon-based compounds formed from long-chain molecules including thermoset polyimides, thermoplastics, resins, polycarbonates, epoxies, and related compounds known to the art.

An embodiment of the present teachings can provide a toner container that is less susceptible to toner leakage than some prior toner containers. The toner container of the present teachings can reduce maintenance costs associate with printer operation and increase print quality and printer lifetime by reducing toner leakage into the internal components of a printer.

Figure 1:
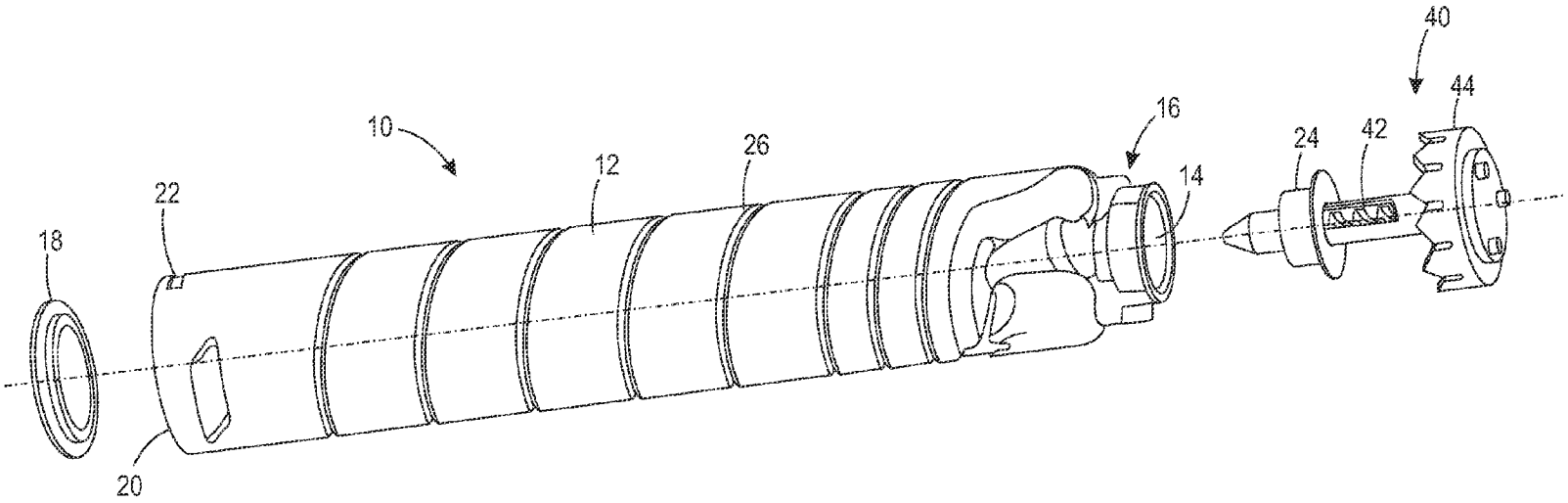
FIG. 1 is a schematic perspective depiction of a toner container in accordance with an embodiment of the present teachings.

FIG. 1 depicts a toner container assembly 10 in accordance with an embodiment of the present teachings, and a dispense auger assembly 40 that may be part of a printer.

The toner container assembly 10 may include a container 12 having a dispense opening 14 at a dispense end 16 of the container 12, a toner fill plug 18 positioned during use within a fill opening 20 at a fill end 22 of the container 12, and a seal assembly 24 that, during use, is positioned within the dispense opening 14. The surface of the container 12 may include one or more surface grooves 26.

The dispense auger assembly 40 includes a dispense auger 42 and a container drive coupling 44 in accordance with known printer structures.

Prior to use, the container 12 is filled with a toner 90 (FIG. 4) through the fill opening 20, and the toner fill plug 18 is placed into the fill opening 20 to contain the toner 90 within the container 12. The toner container assembly 10 is placed onto the auger assembly 40 allowing the auger tube 42 to enter the container 12 through the dispense opening 14. The auger assembly 40 is positioned so that the dispense auger 42 extends through an opening in the seal assembly 24 and into the container 12. During use, the container and/or the dispense auger 42 is rotated such that toner within the container 12 is scooped up by the dispense auger 42 and transported to a print engine (not individually depicted for simplicity). During use, the one or more surface grooves 26 assist in urging the toner toward the dispense end 16 and the dispense auger 42 during rotation of the container 12.

Figure 2:
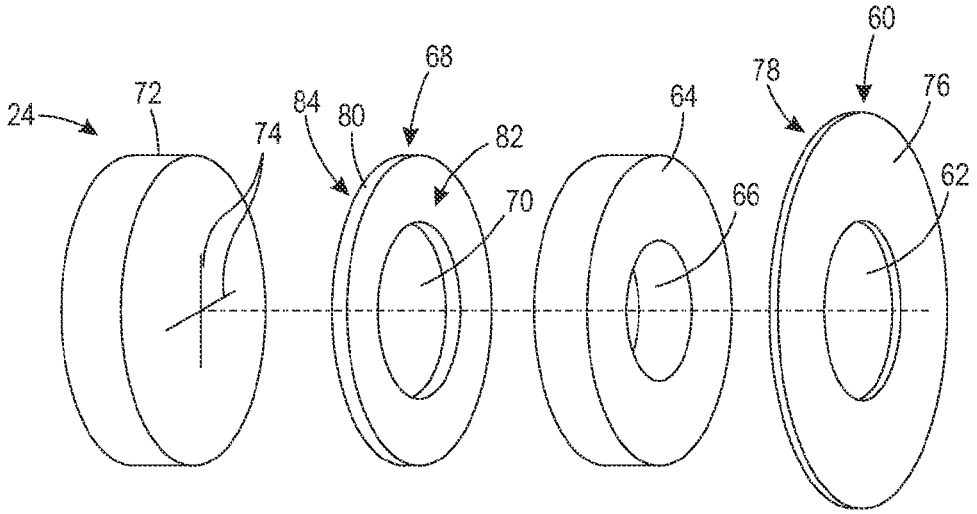
FIG. 2 is a schematic perspective depiction of a seal assembly in accordance with an embodiment of the present teachings.
Figure 3:
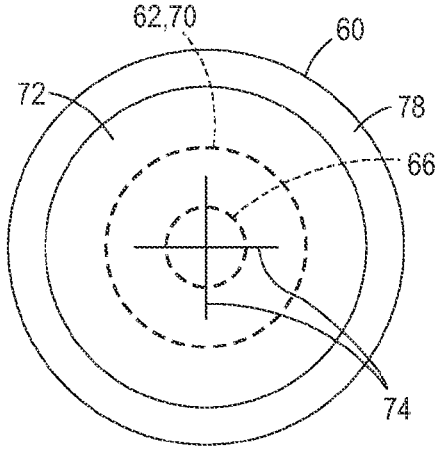
FIG. 3 is a schematic end view of the seal assembly of FIG. 2.

A seal assembly 24 according to an embodiment of the present teachings is depicted in the exploded schematic perspective depiction of FIG. 2. The seal assembly 24 includes an outer retainer ring 60 having a hole 62 therethrough and an adhesive 78 on an inboard face, a foam ring 64 having a hole 66 therethrough, a double-sided adhesive ring 68 having a hole 70 therethrough, and a solid foam disc 72 having a pair of intersecting slits 74 (i.e., a cross-shaped slit) therethrough. FIG. 3 depicts an assembled seal assembly 24 when viewed from the solid foam disc 72 side. A major surface of the solid foam disc 72 physically contacts the double-sided adhesive ring 68. A major surface of the foam ring 64 physically contacts the adhesive 78 on the inboard surface of the outer retainer ring 60. The outer retainer ring 60 has adhesive 78 on only one side, and is therefore a single-sided adhesive ring including adhesive 78.

An exemplary use of a seal assembly 24 with a dispense auger 42 having a diameter of from about 12 mm to about 18 mm, for example about 15 mm is described below. It will be appreciated that the size of each of the individual elements of the seal assembly 24 may vary depending on the specific individual configuration of the container 12 and the auger assembly 40.

The adhesive 78 on the outer retainer ring 60 is adhered to a major surface of the foam ring 64. The adhesive 78 on the outer retainer ring 60 is used to adhere the completed seal assembly 24 to the container 12 and, more specifically, to a container lip 28 that defines the dispense opening 14. As such, the outside diameter of the outer retainer ring 60 will be larger than the outside diameters of any of the other seal assembly components 64, 68, 72. For example, the outer retainer ring 60 may have an outside diameter of from about 38 mm to about 44 mm, for example about 41 mm. The opening 62 through the ring 60 may have a diameter that is smaller than a diameter of the double-sided adhesive ring 68, but which is larger than a diameter of the opening 66 through foam ring 64. For example, the opening 62 through the outer retainer ring 62 can be from about 17 mm to about 23 mm, for example about 20 mm. The outer retainer ring 60 may include a non-adhesive carrier material 76 and an adhesive layer 78 on a major surface of one side of the carrier material 76. For example, the non-adhesive carrier material 76 may be a polymer such as polyethylene terephthalate (PET) or a biaxially oriented polyethylene terephthalate polyester resin film such as Mylar® (available from E. I. DuPont de Nemours, Inc. of Wilmington, Del.). The adhesive layer 78 may be an acrylic adhesive or another adhesive such as a pressure adhesive, a thermoset adhesive, a thermoplastic adhesive, a heat-curable adhesive, etc. The outer retainer ring 60 may have a thickness of from about 0.25 mm to about 0.75 mm, for example about 0.5 mm.

The foam ring 64 may be manufactured to include a foam material, for example a polymer foam such as a polyethylene foam, a urethane foam, etc. The foam ring 64 can have an outside diameter of from about 29 mm to about 35 mm, for example about 32 mm. The foam ring 64 may have a thickness of from about 4 mm to about 8 mm, for example about 6 mm.

In general, the opening 66 through the foam ring 64 will have a shape that matches a cross sectional shape of the dispense auger 42, and a width or diameter that is about the same as, or slightly smaller than, the width or diameter of the dispense auger 42. The opening 66 through the foam ring 64 can be from about 5 mm to about 11 mm, for example about 8 mm.

The double-sided adhesive ring 68 may be a single layer of adhesive 80. In another embodiment, the double-sided adhesive ring 68 may include a non-adhesive carrier 80 having a first adhesive layer 82 on a first side (i.e., a first major surface) of the carrier 80 and a second adhesive layer 84 on a second side (i.e., a second major surface) of the carrier 68. The double-sided adhesive ring 68 will adhere the foam ring 64 to a major surface of the solid foam disc 72. The double-sided adhesive ring 68 can have an outside diameter of from about 29 mm to about 35 mm, for example about 32 mm. The opening 70 through the double-sided adhesive ring 64 may be about the same size as the opening 62 through the outer retainer ring 60, and may be from about 17 mm to about 23 mm, or about 20 mm. The double-sided adhesive ring 68 may have a thickness of from 0.1 mm to about 0.3 mm, or about 0.2 mm. In an embodiment including the use of a carrier, the non-adhesive carrier material 80 may be a polymer such as polyethylene terephthalate (PET) or a biaxially oriented polyethylene terephthalate polyester resin film such as Mylar®. In either a carrier embodiment, or a standalone adhesive embodiment, the adhesive may be an acrylic adhesive or another adhesive such as a pressure adhesive, a thermoset adhesive, a thermoplastic adhesive, a heat-curable adhesive, etc.

The solid foam disc 72 may be manufactured to include a foam material, for example a polymer foam such as a polyethylene foam, a urethane foam, etc. The solid foam disc 72 can have an outside diameter of from about 29 mm to about 35 mm, or about 32 mm. Each slit 74 through the solid foam disc 72 may have a length of from about 10 mm to about 20 mm, or from about 13 mm to about 18 mm, or about 15.5 mm, or of a size sufficient so that damage to the solid foam disc 72 does not result from insertion and withdrawal of the dispense auger 42 during use. The two slits 74 may be approximately perpendicular to each other and cross at a center of each slit 74 as depicted. The solid foam disc 72 may include exactly two slits 74, or may include more than two slits 74. In an embodiment, the two or more slits may be straight or curved. The solid foam disc 72 may have a thickness of from about 4 mm to about 8 mm, for example about 6 mm.

Thus, as described above, each of the foam ring 64, the double-sided adhesive ring 68, and the solid foam disc 72 may have approximately equal outside diameters, where each outside diameter is about the same as the diameter of the dispense opening 14. In another embodiment, the outside diameter of the double-sided adhesive ring 68 may be smaller than the outside diameters of the foam ring 64 and the solid foam disc 72, as long as the double-sided adhesive ring 68 is sufficient to adhere structures 68, 72 together during use.

Figure 4:
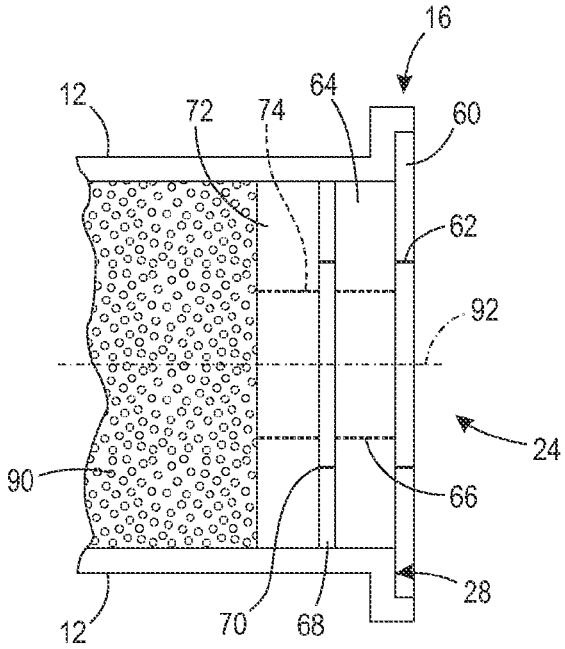
FIG. 4 is a schematic cross section of a seal assembly positioned within a toner container.
Figure 5:
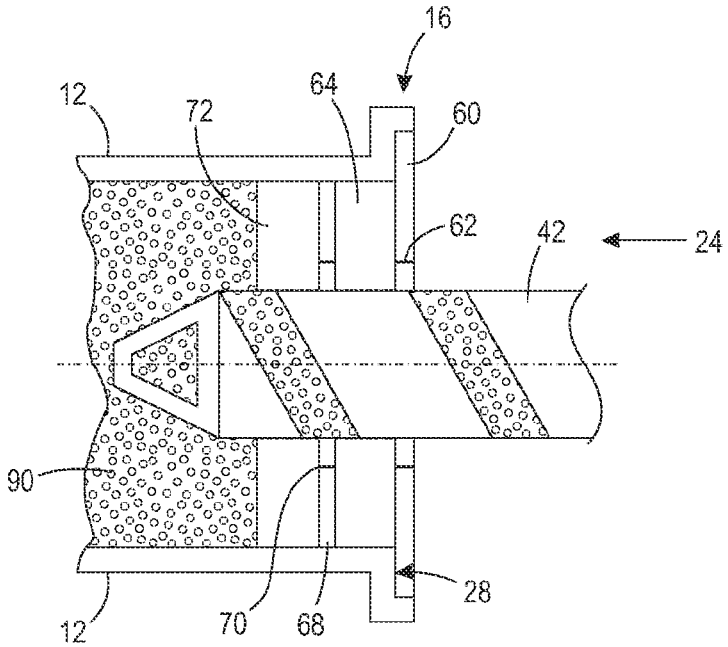
FIG. 5 depicts the FIG. 4 structure after insertion of a dispense auger through the seal assembly.

During use of the container 12, the seal assembly 24 is positioned within the opening 14 in the toner container 12 as depicted in FIG. 4. The seal assembly 24 seals the toner 90 within the container 12 and reduces or prevents leakage of toner 90 from the container 12 during shipment and storage, and during installation into a printer, normal use, and removal from the printer during replacement. Each of the openings 62, 66, and 70, and the center of each of the slits 74, align with each other along an axis 92 of the seal assembly 24, wherein the axis is perpendicular to the major surface of the outer retainer ring 60, the major surface of the foam ring 64, the major surface of the double-sided adhesive ring 68, and the major surface of the solid foam ring 72. The interior edges of the solid foam disk 72 that define the slits 74 within the solid foam disc 72 contact each other to seal the toner 90 within the container 12. Because the diameter of the opening 66 within the foam ring 64 is smaller than a length of the slits 74, the foam ring 64 seals the outside extent (e.g., each end) of each of the slits 74. To dispense the toner 90, the dispense auger 42 is inserted into the opening 62 through the outer retainer ring 60, into the opening 66 through the foam ring 64, into the opening 70 through the double-sided adhesive ring 68, and into the slits 74 through the solid foam disc 72 as depicted in FIG. 5. During replacement of the toner container 12, the dispense auger is withdrawn from the various openings and slits in the seal assembly 24.

In contrast to prior seal assemblies for toner containers that use only a slit seal assembly, the seal assembly according to an embodiment of the present teachings includes a solid foam disk 72 having at least two slits 74 therein attached with a double-sided adhesive ring 68 to a foam ring 64 having an opening 66 therein. The opening 66 in the foam ring 64 has a width or diameter that is about the same size, or smaller than, a width of the dispense auger 42. The foam ring 64 lays against the ends of the slits 74 to prevent toner 90 from leakage at the ends of the slits 74 during shipping and storage of the toner container assembly, insertion of the dispense auger 42 into the seal assembly 24, use of the toner container assembly within a printer, and withdrawal of the dispense auger 42 from the seal assembly 24. Additionally, the foam ring 64 provides a circumferential seal around the dispense auger 42 to reduce or prevent leakage of toner 90 from between any other areas of incomplete contact of the solid foam disc 72 and dispense auger 42.

Various techniques may be used to manufacture a seal assembly 24 according to the present teachings, which will be apparent to those of skill in the art from the description herein.

It will be appreciated the FIGS. represent generalized schematic illustrations where other structures may be added and existing structures may be removed or modified. For example, the double-sided adhesive ring 64 may be another adhesive layer that is not an adhesive ring, as long as the solid foam disc 72 is sufficiently attached to the foam ring 64.

Figure 6:
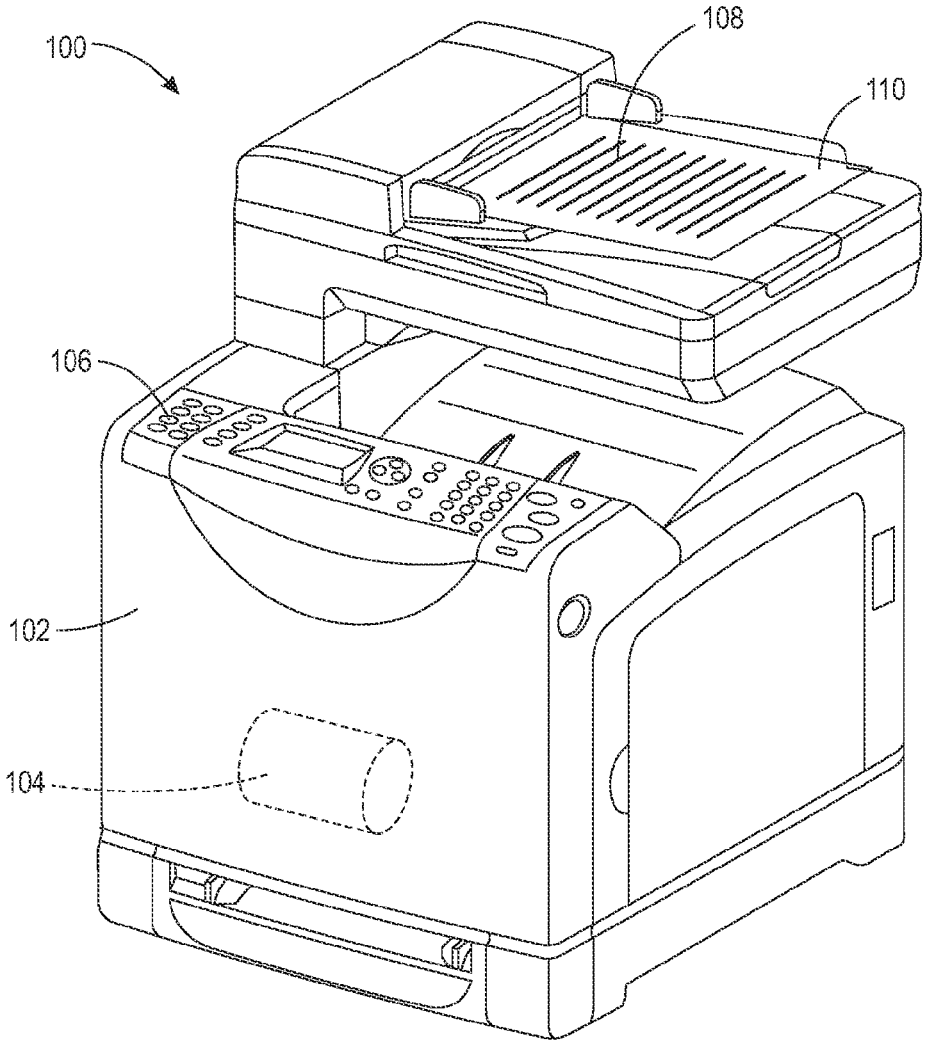
FIG. 6 is a schematic perspective depiction of a printer including a toner container assembly in accordance with an embodiment of the present teachings.

FIG. 6 depicts a printer 100 that includes an embodiment of the present teachings. The printer 100 includes a printer housing 102 into which at least one toner container 10 (FIG. 1) including the seal assembly 24 has been installed and that encases the toner container 10. During operation, toner 90 (FIG. 5) is transferred from the toner container 10, for example using the dispense auger assembly 40 (FIG. 1), to a print engine 104. The print engine 104 is operated in accordance with digital instructions and user input from a printer control panel 106 to create text and/or images 108 on a print medium 110 such as a paper sheet, plastic, etc. from the toner 90.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A toner container assembly for a printer, the toner container assembly comprising a seal assembly, wherein the seal assembly comprises:

an outer retainer ring comprising a non-adhesive carrier, a first adhesive layer on a surface of the non-adhesive carrier, and a first opening through the outer retainer ring, wherein the outer ring has an outside diameter of from 38 mm to 44 mm;

a foam ring comprising a second opening therethrough, wherein the foam ring is attached to the outer retainer ring with the first adhesive and has an outside diameter of from 29 mm to 35 mm;

a double-sided adhesive ring attached to the foam ring comprising a third opening therethrough, wherein the double-sided adhesive ring has an outside diameter of from 39 mm to 35 mm; and a solid foam disc comprising a first slit therethrough, a second slit therethrough, a major surface that physically contacts the double-sided adhesive ring, and an outside diameter of from 29 mm to 35 mm, wherein:

the first slit is perpendicular to the second slit and the solid foam disc is attached to the foam ring by the double-sided adhesive layer; and the first opening, the second opening, the third opening, a center of the first slit, and a center of the second slit are generally aligned along an axis that is perpendicular with the major surface of the solid foam disc.

2. The toner container assembly of claim 1, further comprising:

a toner container comprising an opening therein at a dispense end of the toner container;

the seal assembly is positioned within the opening in the toner container; and the seal assembly is attached to the toner container using the outer retainer ring and the first adhesive.

3. The toner container assembly of claim 1, wherein:

the outer retainer ring has a thickness of from 0.25 mm to 0.75 mm;

the double-sided adhesive layer has a thickness of from 0.1 mm to 0.3 mm;

the foam ring has a thickness of from 4 mm to 8 mm;

the solid foam disc has a thickness of from 4 mm to 8 mm; and each slit has a length of from 10 mm to 20 mm.

4. The toner container assembly of claim 3, wherein:

the first opening through the outer retainer ring is from 17 mm to 23 mm;

the second opening through the foam ring has a diameter of from 5 mm to 11 mm; and the third opening through the double-sided adhesive ring has a diameter of from 17 mm to 23 mm.

5. The toner container assembly of claim 1, wherein the foam ring and the solid foam disk comprise at least one of a polyethylene foam and a urethane foam.

6. A printer, comprising:

a toner container assembly comprising a seal assembly, wherein the seal assembly comprises:

a outer retainer ring comprising a non-adhesive carrier, a first adhesive layer on a surface of the non-adhesive carrier, and a first opening through the outer retainer ring;

a foam ring comprising a second opening therethrough, wherein the foam ring is attached to the outer retainer ring with the first adhesive;

a double-sided adhesive layer attached to the foam ring; and a solid foam disc comprising a first slit therethrough and a second slit therethrough, wherein the first slit is perpendicular to the second slit and the solid foam disc is attached to the foam ring by the double-sided adhesive layer;

a dispense auger, wherein the dispense auger is positioned within the first opening through the outer retainer ring, the second opening through the foam ring, and the third opening through the double-sided adhesive layer; and a printer housing that encases the toner container assembly.

7. The printer of claim 6, further comprising:

a toner container comprising an opening therein at a dispense end of the toner container;

the seal assembly is positioned within the opening in the toner container; and the seal assembly is attached to the toner container using the outer retainer ring and the first adhesive.

8. The printer of claim 6, wherein:

the double-sided adhesive layer is a double-sided adhesive ring comprising a third opening therethrough;

a major surface of the solid foam disc physically contacts the double-sided adhesive ring; and the first opening, the second opening, the third opening, a center of the first slit and a center of the second slit are generally aligned along an axis that is perpendicular with the major surface of the solid foam disc.

9. The printer of claim 8, wherein:

the outer retainer ring has an outside diameter of from 38 mm to 44 mm;

the double-sided adhesive ring has an outside diameter of from 29 mm to 35 mm;

the foam ring has an outside diameter of from 29 mm to 35 mm; and the solid foam disc has an outside diameter of from 29 mm to 35 mm.

10. The printer of claim 8, wherein:

the outer retainer ring has a thickness of from 0.25 mm to 0.75 mm;

the double-sided adhesive layer has a thickness of from 0.1 mm to 0.3 mm;

the foam ring has a thickness of from 4 mm to 8 mm;

the solid foam disc has a thickness of from 4 mm to 8 mm; and each slit has a length of from 10 mm to 20 mm.

11. The printer of claim 10, wherein:

the first opening through the outer retainer ring is from 17 mm to 23 mm;

the second opening through the foam ring has a diameter of from 5 mm to 11 mm; and the third opening through the double-sided adhesive ring has a diameter of from 17 mm to 23 mm.

12. The printer of claim 11, wherein the foam ring and the solid foam disk comprise at least one of a polyethylene foam and a urethane foam.

13. The printer of claim 6, further comprising a toner within the toner container.

14. The printer of claim 13, further comprising a print engine encased within the printer housing, wherein the dispense auger is configured to transport the toner to the print engine.

15. A toner container assembly for a printer, the toner container assembly comprising a seal assembly, wherein the seal assembly comprises:

an outer retainer ring comprising a non-adhesive carrier, a first adhesive layer on a surface of the non-adhesive carrier, and a first opening through the outer retainer ring, wherein the outer retainer ring has a thickness of from 0.25 mm to 0.75 mm;

a foam ring comprising a second opening therethrough, wherein the foam ring is attached to the outer retainer ring with the first adhesive and has a thickness of from 4 mm to 8 mm;

a double-sided adhesive ring attached to the foam ring comprising a third opening therethrough, wherein the double-sided adhesive layer has a thickness of from 0.1 mm to 0.3 mm; and a solid foam disc comprising a first slit therethrough, a second slit therethrough, and a major surface that physically contacts the double-sided adhesive ring, wherein:

the solid foam disc has a thickness of from 4 mm to 8 mm;

each slit has a length of from 10 mm to 20 mm;

the first slit is perpendicular to the second slit and the solid foam disc is attached to the foam ring by the double-sided adhesive layer; and the first opening, the second opening, the third opening, a center of the first slit, and a center of the second slit are generally aligned along an axis that is perpendicular with the major surface of the solid foam disc.

* * * * *